US007036683B2

(12) United States Patent
Dubach

(10) Patent No.: US 7,036,683 B2
(45) Date of Patent: May 2, 2006

(54) PLASTIC CLOSING DEVICE WITH A PIERCING ELEMENT

(75) Inventor: Werner Fritz Dubach, Maur (CH)

(73) Assignee: Bericap Holding GmbH, Budenheim (DE)

( * ) Notice: Subject to any disclaimer, the term of this patent is extended or adjusted under 35 U.S.C. 154(b) by 65 days.

(21) Appl. No.: 10/398,108

(22) PCT Filed: Sep. 27, 2001

(86) PCT No.: PCT/CH01/00582

§ 371 (c)(1),
(2), (4) Date: Apr. 1, 2003

(87) PCT Pub. No.: WO02/28728

PCT Pub. Date: Apr. 11, 2002

(65) Prior Publication Data

US 2004/0104245 A1 Jun. 3, 2004

(51) Int. Cl.
*B67D 5/00* (2006.01)

(52) U.S. Cl. ..... 222/83

(58) Field of Classification Search ..... 222/81, 222/83, 541.5; 220/227
See application file for complete search history.

(56) References Cited

U.S. PATENT DOCUMENTS

| | | | | |
|---|---|---|---|---|
| 4,747,501 | A | 5/1988 | Greaves | |
| 4,884,705 | A | 12/1989 | Debetencourt | |
| 5,297,696 | A | 3/1994 | Bernstein et al. | |
| 5,482,176 | A * | 1/1996 | Maietta et al. | 220/277 |
| 5,810,184 | A | 9/1998 | Adams et al. | |
| 5,960,992 | A | 10/1999 | Bernstein et al. | |
| 6,279,779 | B1 * | 8/2001 | Laciacera et al. | 222/83 |
| 6,398,075 | B1 * | 6/2002 | Laciacera et al. | 222/91 |
| 6,422,412 | B1 | 7/2002 | Sagawa | |
| 6,820,764 | B1 * | 11/2004 | Miani et al. | 222/83 |
| 2002/0179605 | A1 * | 12/2002 | Miani et al. | 220/277 |

FOREIGN PATENT DOCUMENTS

| | | |
|---|---|---|
| EP | 328 652 | 8/1989 |
| EP | 543 119 | 5/1993 |
| EP | 96/11850 | 4/1996 |
| EP | 1 088 765 | 4/2001 |
| FR | 2 765 194 | 12/1998 |
| JP | 10-139057 | 5/1998 |
| WO | 99/42375 | 8/1999 |
| WO | 99/62776 | 12/1999 |

* cited by examiner

*Primary Examiner*—Eric Keasel
(74) *Attorney, Agent, or Firm*—Pauley Petersen & Erickson

(57) ABSTRACT

A closing device for a container having a bung-type lower part with a cylindrical pour spout. The cylindrical pour spout has a female thread in which a cylindrical piercing element that is open to both sides and that has a male thread is retained by a screw connection. A screw cap can be placed on the lower part. The screw cap has a driver that interacts with a driver in the piercing element. A fine-pitch thread is between the screw cap and the lower part and a coarse-pitch thread is between the lower part and the piercing element. The combined screw/translational motion of the piercing element and the selected threads produce a highly effective cutting motion.

11 Claims, 2 Drawing Sheets

PLASTIC CLOSING DEVICE WITH A PIERCING ELEMENT

BACKGROUND OF THE INVENTION

1. Field of the Invention

This invention relates to a closure device made of plastic, which can be applied over a location, which can be punctured, of a closed container.

2. Discussion of Related Art

Various containers, particularly for storing flowable media, are available in commerce, wherein prior to opening them it is necessary to pierce a foil, or membrane, or even the container wall itself before the liquid medium can be removed from the container. For example, such containers are called soft cartons made of single-layer or multi-layered foil or coated cardboard, on which a closure device is glued or welded, wherein the closure device comprises a screw cap. Closure devices for such cartons have a lower element with a cylindrical pouring spout with an outer thread and a lower flange on the edge for fastening on the soft carton. Before the contents can be taken out of the soft carton it is necessary to unscrew the screw cap from the lower element and to puncture the container wall in the area of the pouring spout. The closure device has an integrated piercing element for puncturing the container wall in the area of the container opening.

Two systems in particular are known. With one system the screw cap is removed in a first step, and in the second step the piercing element is moved downward by the user for puncturing the container wall. Typical representatives of this version are known, for example, from European Patent Reference EP-A-0 543 119 and U.S. Pat. No. 5,297,696. So that the piercing element of such a closure device can be reasonably operated, the cylindrical pouring spout must have a lateral recess, which extends in the axial direction and approximately corresponds to the width of a finger. This known version is relatively simple in construction, however, it has one disadvantage that the pouring properties of such a closure are poor and there is a great danger that while actuating the piercing element the finger contacts the liquid contents. This leads to soiling of the finger and to the contamination of the liquid contents. This is particularly disadvantageous, because the containers are especially used for beverages, whose ability to keep is considerably reduced by contamination.

In a second version, there is an interactive effect between the screw cap and the piercing element. In the most frequent cases, the piercing element is pushed down through the container wall with the help of the screw cap. For this purpose, the screw closure is in an upwardly displaced position relative to the lower element prior to first opening, which in most cases is bridged by a security strip. Accordingly it is necessary to first remove the security strip, whereafter the closure is screwed down completely during which the screw cap, as well as the piercing element seated in the pouring spout are moved downward. Therefore the soft carton is punctured and opened during complete closure by the screw cap. In a third step it is necessary to completely unscrew the screw cap before the contents are freely accessible and can be poured out. A typical representative of this closure version is known from PCT International Publication WO 96/11850, for example. A closure device in accordance with PCT International Publication WO 99/64315 operates in a similar manner. With this device the piercing element has two sections of thread in different directions of lead. In a first screwing movement the piercing element is pushed through the container wall, and then the screw cap is unscrewed from the piercing element in the opposite turning direction.

While closures of this type are relatively new in connection with soft cartons, such closure devices are already known in various embodiments in an analogous construction for containers in the form of bottles, having container neck sealed by a membrane or foil. Closure devices of this type have not been successful in commerce. Besides frequently occurring sealing problems, one main problem is that the opening process does not agree with the habits of the consumer. It is therefore necessary to display elaborate instructions of how to open the carton. This is not only undesirable, but experience has shown that these instructions are hardly observed and that the consumer reads these instructions only after he already has destroyed the closure or rendered it ineffective.

On the basis of this knowledge, PCT International Publication WO 99/42375 proposes a device in which a piercing element cooperates interactively with a screw cap so that, in the course of simple unscrewing the screw cap, the piercing element is simultaneously moved so that it is conveyed downward and punctures the carton wall. This closure device is absolutely simple to operate and is comfortable for the consumer. However, in connection with this closure device the piercing element must be applied so it adheres to the carton wall, which is problematic. The punctured portion of the carton wall is caught on the piercing element. The edges of the carton wall remaining on the piercing element remain fixedly connected with it, even after first opening. The piercing element itself remains in the screw cap and is taken out when the screw cap is opened. Because paper or cardboard is a part of most soft cartons, the destroyed container wall, which is fixedly glued to the piercing element, again and again contacts the contents of the container and is conveyed outward again at each opening and can be repeatedly contaminated in the process, and residue from the liquid adhering to it can also be contaminated or oxidize, and thereafter again contact the contents when the screw cap is closed. Besides these undesirable use properties, this closure device has one disadvantage that it is extremely complex and expensive to mount. The reason for this is that the lower element and the piercing elements, must be glued or welded to the container wall. While the flange of the lower element can be welded on, depending on the carton material, the piercing element must be glued on in every case. If insufficient adhesive is applied, the piercing element is torn off the carton wall during opening without the carton necessarily being opened. If too much adhesive is used, adhesive connections between the piercing element and the lower element are formed and the screw cap can hardly be screwed on without the threads being stripped in the process.

A closure device is known from European Patent Reference EP-A-0 328 652. It is simple to operate, because when unscrewing the screw cap for the first time the piercing element is moved linearly downward and thus the membrane or the container wall is punctured.

Soft cartons necessarily must have a pre-punched predetermined opening spot. Such a predetermined opening spot is achieved by an impression stamping, by which the foil or the foil connection is only partially punched without achieving penetration, so that the piercing element makes possible the complete puncturing with little force. This is an extremely tricky punching operation, and thus the partial punching is relatively often too ineffective, so that required force the piercing element must generate is very large.

With the known closure device taught by European Patent Reference EP-A-0 328 652, the axially acting force is exerted on the piercing element by the screw cap, and the screw thread of the screw cap must be able to absorb this force. Accordingly, the screw thread on the cylindrical lower element and on the inner surface of the jacket wall of the screw cap must be made strong, with a large lead.

However, this is undesirable because a screw thread as a whole requires a more solid construction with increased wall thickness, which results in an additional weight of one to three grams even with relatively small closure devices. As the number of pieces required here is more than $10^9$ pieces/year, a savings of material in the amount of more than 1000 tons of plastic material results, if a reduced lead can be realized.

With the solutions known today, and in particular also with the solution in accordance with PCT International Publication WO 99/62776, or the above mentioned European Patent Reference EP-A-0 328 652, the entire translatorial movement of the piercing element can be practically distributed only to a rotatory movement over 180° of the screw cap. Accordingly, the required force for the first actuation of the screw cap is large and depends greatly on the toughness of the material the piercing element has to puncture.

SUMMARY OF THE INVENTION

It is one object of this invention to provide a closure device of the type mentioned above but wherein the force transfer from the screw cap to the piercing element can be accomplished with small axial forces acting on the screw cap.

This object is attained by a closure device having features set forth in this specification and in the claims.

BRIEF DESCRIPTION OF THE DRAWINGS

One embodiment of this invention is shown in detail in the drawings, wherein:

FIG. 1 shows a vertical diametrical section taken through the closed closure device prior to first use, while FIGS. 2 to 4 show details of a similar closure device in perspective positions, wherein:

FIG. 2 shows the lower element in a perspective top view;

FIG. 3 shows the piercing element also in a perspective top view;

FIG. 4 shows the screw cap in a perspective bottom view; and

DESCRIPTION OF PREFERRED EMBODIMENTS

Figure 1:
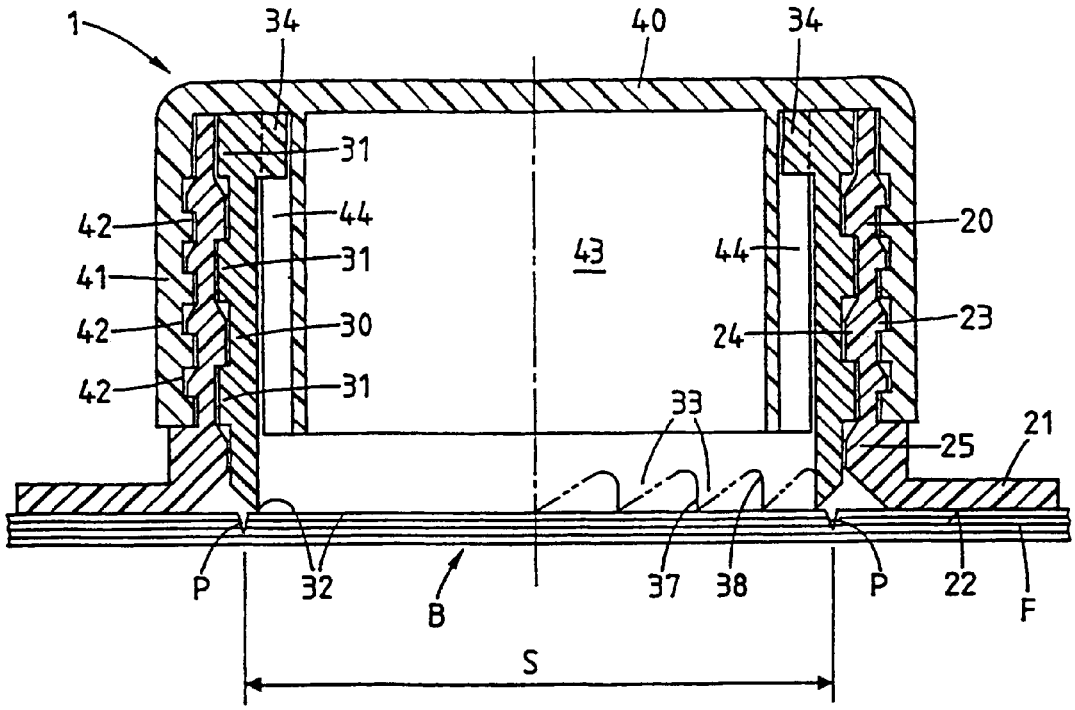

The closure device, identified by element numeral 1 as a whole, is shown in FIG. 1 in a vertical diametrical section. The position shown there shows the closure device 1 fastened on a container B. In this case the container is a soft carton made of a foil or multi-layer foil F. Soft cartons are understood to be containers made from coated cardboard or a laminated foil, which have a predetermined opening spot S which has been provided by impression stamping P. Certain layers of the foil F are cut by this impression stamping, while the innermost located layers or layer remain unaffected.

However, in accordance with this invention it is also possible to use soft cartons in which an appropriate opening has already been punched. With the first variation the lower element 2, still to be described, is welded or glued to the outside of the foil F. Fastening with the second variation occurs by welding or gluing to the outside or inside, wherein in the latter case the lower element 2 extends through the provided opening. In the last two variations mentioned, an appropriate membrane is then provided, which must be pierced.

Without it being necessary to represent such an embodiment, it is apparent to one skilled in the art that the solution in accordance with this invention can also be realized so that the lower element 2 represents an integral component of the container. In this case the lower element 2 corresponds to an appropriately designed container neck.

Figure 3:
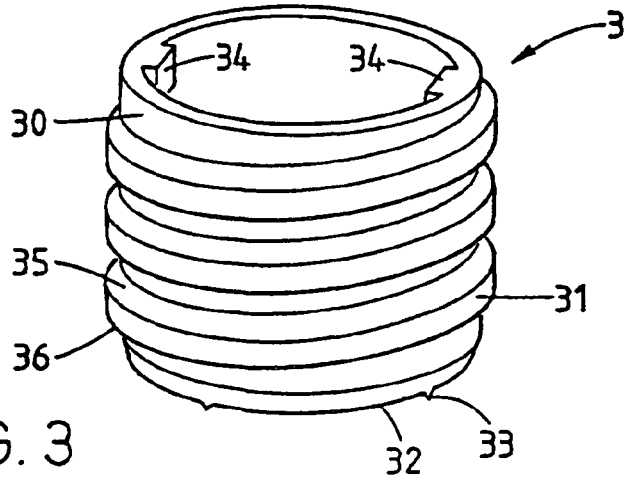
Figure 2:
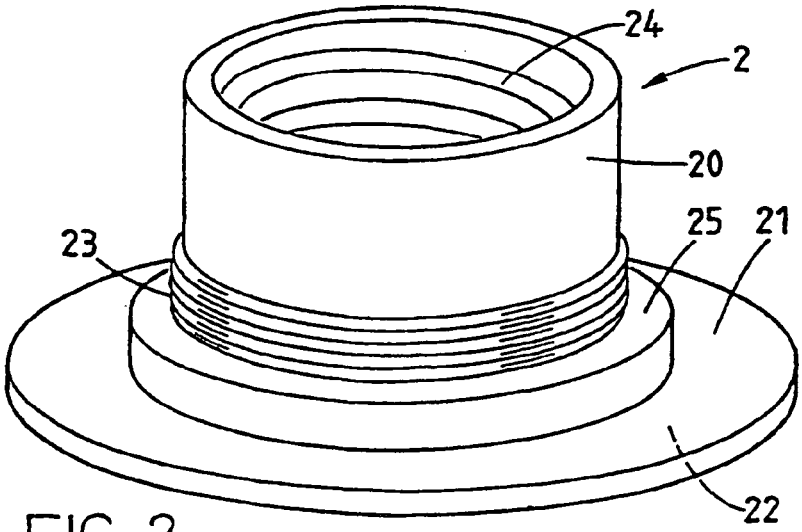

The following detailed description of a preferred embodiment refers to FIGS. 1 to 4. FIGS. 2 and 3 represent the three main components in an overall exploded view.

The lower element 2 is shown in detail in FIG. 2. The lower element 2 is in the shape of a spout and has a flange 21, with an underside or top that constitutes a welding or gluing surface 22. In this way the connection of the closure device 1 with the container B is provided by the flange 21. The flange 21 is formed flush as one piece on the lower edge of the cylindrical pouring spout 20. The cylindrical pouring spout 20 has a rough-pitch multiple-start inner thread 24 with a relatively low lead of the turns. The cross section of the thread turns is preferably trapezoidal. Here, the flank of the thread turns which is on top in the installed position is inclined, while the lower flank projects practically at right angles away toward the interior from the cylindrical wall of the pouring spout 20. This permits an improved pull-out of the core from the injection mold during production and an easier ratchet-like overlapping of this thread with the outer thread of the piercing element 3, which has an outer thread which is correspondingly oppositely threaded. The multiple-start of the thread permits the realization of an increased force transfer and a less steep course of the thread, while at the same time positioning during the assembly is less tricky.

On the outside of its cylindrical jacket wall, the pouring spout 20 has an outer thread 23. While in the embodiment in accordance with FIG. 1 this outer thread extends over practically the entire height of the pouring spout 20 and has a conventional thread, a preferred embodiment is shown in FIG. 2, in which the outer thread is only arranged in the lower area and is designed as a fine-pitch thread. Such a fine-pitch thread not only saves material, but also has an advantage that no exact angle-related positioning is required during assembly. The fine-pitch thread picked here can be selected because, in contrast to the prior art, the axially occurring forces during the actuation of the piercing element need not be absorbed by the screw cap 4. Only radial movements are exerted on the piercing element by the screw cap 4, wherein the thread between the screw cap 4 and the lower element 2 remains practically unstressed. A ring-shaped detent bead 25 is formed between the outer thread 23 and the flange at the lower part of the pouring spout 20. On the one hand, this detent bead 25 absorbs the forces acting on the lower element 1 when pressing down the screw cap 4. In this way the screw cap 4 can be directly pressed down until it is in contact with the detent bead 25. However, the detent bead 25 can additionally have positive connecting means, not represented here, which can cooperate with a security strip on the screw cap 4. Such a security strip is not the subject of this invention and is omitted from the drawings for clarity.

A correspondingly designed piercing element 3 fits into the pouring spout 20 of the lower element 2. The piercing element 3 is in the shape of a cylindrical piece of tubing. This piece of tubing is formed by a cylindrical wall 30 having an outer thread 31, whose shape is appropriately matched to the inner thread 24 of the lower element 2. This outer thread 31 also has a relatively low lead of the turns. The turns of the again multiple-start thread 31 also has a trapezoidal cross section. In contrast to the inner thread 24, the upper flank 35 extends very steeply, or respectively almost vertically, in relation to the cylindrical wall 30. The thread flank 36 which is on the bottom in the installed state, however, is relatively strongly inclined. Here, too, this design shape permits an improved removal from the injection mold and an easier ratchet-like introduction of the piercing element 3 into the lower element 2. The lower edge of the piercing element 3 is designed as a cutting edge 32. Accordingly, the cylindrical wall 30 is shaped so it inclines from the outside to the inside and forms a sharp-edge cutting edge. Perforating teeth 33 can be additionally formed on the cutting edge 32.

On its inner surface, the cylindrical wall 30 has at least one catch element 34 protruding toward the center. Depending on the design, however, it is also possible to attach two or four such catch elements 34. In the embodiment in accordance with FIG. 3, the catch elements 34 are designed as cams, which have an approximately rectangular cross section. However, the catch elements 34 can also be embodied as ribs, which extend continuously in the axial direction.

In a particularly preferred variation, the lower element 2 and the piercing element 3 can be produced, axially aligned in relation to each other in the vertical direction, in one piece, wherein they are connected at the place where they are joined via several predetermined breaking points. Thus the assembly can be performed particularly easily by merely pressing the two elements into each other. An alignment of the two elements can be omitted, because they have already been produced correctly on top of each other and with the correct angular position to each other during their manufacture.

Figure 4:
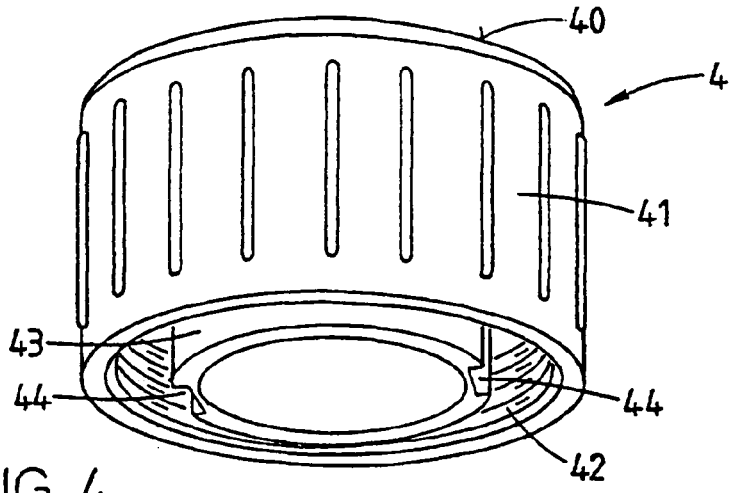

The screw cap 4 is shown in FIG. 4. It has a cover face 40 and the circumferential jacket wall 41. The inner thread 42 is formed on the inside of the jacket wall 41 and cooperates with the outer thread 23 on the pouring spout 20 and thus this thread is also designed as a fine-pitch thread. An annular wall 43 is formed, centered on the cover face 40. This is of a size so that it can be placed with a defined clearance into the interior space of the piercing element 3. The annular wall 43 does not have a sealing function, but is substantially used for driving the piercing element 3. Thus, the annular wall 43 has positive connecting means, which can cooperate with the catch elements 34 at the inner wall of the cylindrical wall 30. The positive connecting means can be a catch groove 44, in which the catch element 34 can slide, or the positive connecting means can be designed as a catch rib 45. In this case the catch rib 45 rests laterally on the catch element 34 during actuation. As mentioned, the catch element 34 can be designed either as a cam or as a longitudinal rib.

Figure 5:
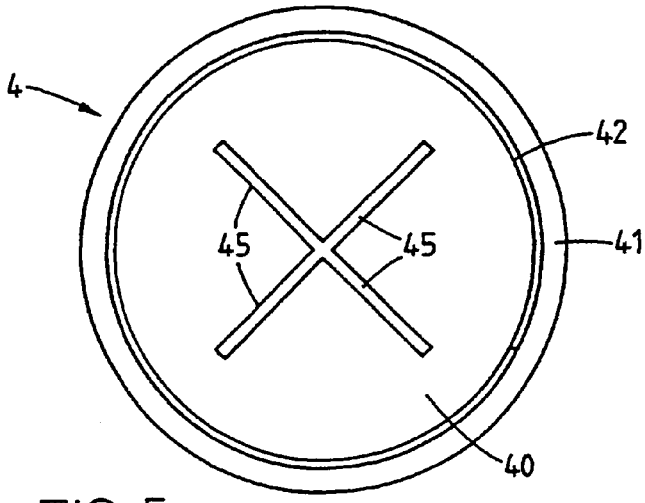
FIG. 5 shows a variation of the screw cap in a top view, looking on the interior surface of the screw cap.

However, the positive connecting means can also be designed without the annular wall 43, as shown in FIG. 5, wherein the interior of a screw cap 4 is represented in a view from below. Here, the jacket wall 41 with the inner thread 42 is formed adjoining the cover face 40. But here two intersecting walls, extending vertically on the cover face 40, are formed, instead of an annular wall 43, and define four catch ribs 45. This solution is used with closure devices of narrower diameter.

As mentioned, the closure device in accordance with this invention can be applied to a soft carton, wherein the connection between the soft carton and the closure device 1 is provided via the lower element 2. It is also possible, and has already been mentioned, for the lower element 2 itself to constitute a part of the container. Finally, it can also be useful to design the lower element as an adapter in order to make the connection with an existing pouring spout of any arbitrary container.

As also mentioned, the piercing element 3 can be formed in one piece with the lower element 2 so that the two elements are aligned flush with each other. Such a solution can be realized because the piercing element is formed above the lower element 2, however, a reverse arrangement is also possible, wherein the piercing element 3 is formed below the pouring spout 20 and is aligned with it via predetermined breaking points. The latter variation has the advantage that the design of the cutting edge is not thus affected. As shown for example in the right half of FIG. 1, the cutting edge 32 can be designed with teeth. The design of the cutting edge 32, whether with or without perforating teeth 33, or with a straight or serrated cutting face, will substantially depend on the material from which the container B, or the membrane which is to be opened by the piercing element, is made.

While up to now the connection between the lower element 2 and the piercing element 3 has always been described as a thread, this is not absolutely required. These positive connecting means at the cylindrical wall of the piercing element and on the inner wall of the spout 20 can also be designed as helical slideways. Corresponding to this, the positive connecting means at the cylindrical pouring spout could be designed as an approximately diametrically opposed, helical guide curve cut into the wall of the pouring spout. In order not to cause a point-like transmission, the mentioned slideway and the guide curve would be matched to each other in such a way that the two rest flat on each other.

As mentioned, the design of the cutting edge can be specifically matched to the material to be punctured. Three different areas of effect can be defined by such a specific embodiment. The first effective area has the perforating teeth 33, which in a first step cause the perforation of the material. Cutting areas 37 will be provided, which directly adjoin the perforating tooth in the direction of rotation, and cause a cutting penetration of the material. Finally, the cutting edge can transition into an obtuse, widened area 38, which is the farthest removed from the perforating tooth in the axial direction and is only used for pushing the cut container wall or membrane out of the area of the pouring opening.

As mentioned, one advantage of this invention is that practically no forces act in the axial direction on the screw cap when it is operated. This advantage also applies with respect to the use of a security strip. Normally security strips, which are separated from the screw cap directly in the course of unscrewing, are connected with the latter by appropriate predetermined breaking points, and these predetermined breaking points must be severed by exerting a force in the axial direction, which occurs in the course of unscrewing the cap. Because with known solutions for a closure device of the type of interest here this force acts together simultaneously with the axial force to be exerted on the piercing element, or is added to it, the total force required for opening was enormously large. A use of a fine-pitch thread would be inconceivable from the start.

One essential principle of the solution according to this invention lies in the new type of kinematics. Instead of achieving the axial movement of the piercing element by the screw cap as previously, it is achieved here by the screwing motion between the piercing element 3 and the lower element 2.

The invention claimed is:

1. In a closure device (1) of plastic, which can be applied over an area of a closed container (B) that can be punctured, wherein the closure device (1) has a spout-shaped lower element (2) with a cylindrical pouring spout (20), and is connectible with the container (B), and a screw cap (4) which can be screwed on the lower element (2), a cylindrical piercing element (3) open at both ends in an axial direction and displaceably seated in the lower element (2), during an unscrewing movement act of the screw cap (4) on the piercing element (3) the piercing element (3) being moved downward into the container (B) through the area (S) which can be punctured, the improvement comprising: on a cylindrical inner wall (30) the piercing element (3) having at least one catch element (34) acting together with at least one catch rib (45) or catch groove (44) of the screw cap (4), during rotating movement of the screw cap (4) the piercing element (3) rotating, and a positive connection (24, 31) between the cylindrical pouring spout (20) of the lower element (2) and the cylindrical piercing element (3) moving the piercing element (3) helically downward during a first unscrewing movement of the screw cap (4), wherein the positive connection at the cylindrical wall (30) of the piercing element (3) includes a slideway which protrudes in a helical manner, the positive connection at the cylindrical pouring spout (20) includes a helical guide curve cut into a wall of the pouring spout (20), and each of the slideway and the helical guide curve including a surface that lies flat on top of a corresponding surface of the other of the slideway and the helical guide curve.

2. In the closure device in accordance with claim 1, wherein the container (B) is a soft carton (F), the cylindrical pouring spout (20) has an outer thread and a lower flange (21) along an edge for fastening to the soft carton, and the area (S) in a container wall located below a pouring opening accessible by the lower element (2).

3. In the closure device in accordance with claim 1, wherein the lower element (2) is an adapter positionable on a membrane-sealed neck of the container (B) and which has a part extending upward over the container neck to form a pouring opening.

4. In the closure device in accordance with claim 1, wherein the lower element (2) is part of the container (B).

5. In the closure device in accordance with claim 1, wherein the lower element (2) and the piercing element (3) are two separate parts.

6. In the closure device in accordance with claim 1, wherein the screw cap (4) has an annular wall (43), and at least one catch rib (45) formed on an outer surface of the annular wall (43), which extends parallel with an axis of rotation of the annular wall (43).

7. In the closure device in accordance with claim 1, wherein the piercing element (3) has at least one cutting edge (32).

8. In the closure device in accordance with claim 7, wherein the cutting edge has three different effective areas, including a first perforating area shaped as at least one perforating tooth (33) which is adjoined on both sides by a cutting area (37), and a second area designed as a displacement area (38) which pushes aside a partially cut container wall (F) or a membrane out of the area of a pouring opening while maintaining a connection with the container wall or the membrane.

9. In the closure device in accordance with claim 1, wherein on a cutting edge (32) oriented toward the container the piercing element (3) has at least one perforating tooth (33).

10. In the closure device in accordance with claim 1, wherein the screw cap (4) forms at least one diametrically extending wall arranged on an inside of a cover face (40) and forms at least one axis-parallel catch rib (45).

11. In the closure device in accordance with claim 1, wherein the slideway of the piercing element (3) comprises a rectangular cross section.

* * * * *

UNITED STATES PATENT AND TRADEMARK OFFICE

CERTIFICATE OF CORRECTION

PATENT NO. : 7,036,683 B2
APPLICATION NO. : 10/398108
DATED : May 2, 2006
INVENTOR(S) : Werner Fritz Dubach It is certified that error appears in the above-identified patent and that said Letters Patent is hereby corrected as shown below:

Cover page, insert --(30) Foreign Application Priority Data--;
--Oct. 03, 2000 (CH) ..... 1939/00--; and insert
--Nov. 09, 2000 (CH) ..... 2181/00--.

Signed and Sealed this

Twentieth Day of May, 2008

JON W. DUDAS
*Director of the United States Patent and Trademark Office*